United States Patent [19]

Maier

[11] Patent Number: 4,729,541

[45] Date of Patent: Mar. 8, 1988

[54] FORMWORK FOR ROUND OR POLYGONAL CONSTRUCTION

[76] Inventor: Josef Maier, Schwimmbadstrasse 3, D-7611 Steinach, Fed. Rep. of Germany

[21] Appl. No.: 888,884

[22] Filed: Jul. 23, 1986

[30] Foreign Application Priority Data

Oct. 16, 1985 [DE] Fed. Rep. of Germany ..... 3536816

[51] Int. Cl.[4] ..... E04G 11/06

[52] U.S. Cl. ..... 249/18; 249/17; 249/153; 249/159; 249/171; 249/179; 249/185; 249/193; 249/194; 264/32; 403/98

[58] Field of Search ..... 249/189, 192, 193, 194, 249/195, 196, 170, 171, 13, 17, 18, 19, 20, 48, 159, 157, 156, 155, 144, 152, 178, 179, 180, 181, 182, 184, 185, 153; 264/32; 403/98, 116, 117

[56] References Cited

U.S. PATENT DOCUMENTS

| | | | |
|---|---|---|---|
| 916,260 | 3/1909 | Briggs | 249/159 |
| 962,560 | 6/1910 | Farrar | 249/159 |
| 1,233,567 | 7/1917 | Furry | 249/194 |
| 3,930,633 | 1/1976 | Wolf | 249/192 |
| 4,619,433 | 10/1986 | Maier | 249/17 |
| 4,624,440 | 11/1986 | Büchler | 249/194 |

FOREIGN PATENT DOCUMENTS

| | | | |
|---|---|---|---|
| 255672 | 5/1963 | Australia | 249/194 |
| 2140638 | 3/1973 | Fed. Rep. of Germany . | |
| 2403325 | 7/1975 | Fed. Rep. of Germany . | |
| 2805612 | 8/1979 | Fed. Rep. of Germany . | |
| 3211882 | 10/1983 | Fed. Rep. of Germany | 249/194 |
| 475096 | 4/1915 | France | 249/17 |

*Primary Examiner*—Jay H. Woo
*Assistant Examiner*—James C. Housel
*Attorney, Agent, or Firm*—Peter K. Kontler

[57] ABSTRACT

There is disclosed a formwork for round or polygonal constructions with a formwork face having an adjustable curvature or circumference. The formwork has a chain of booms which are spaced apart from the formwork face and are composed of individual boom portions. The boom portions can be pivoted relative to one another and can be fixed in selected angular positions when the adjustment of the formwork face is completed. The pivot axes for the boom portions are not located at the boom portions themselves but are transposed into the plane of the formwork face so that the formwork and the formwork face are adjusted in assembled condition of the chain of booms. The boom portions, which are spaced apart from the joint axes have couplings which are adapted to be detachably connected to one another and are disposed along arcs with centers of curvature on the respective joint axes. The couplings can include overlapping plates with openings through which locking keys can be inserted.

29 Claims, 8 Drawing Figures

16
16
16a
16b
4
24
13
13a
15
13a
24
4
15
13
13a
14a
15
13a
14
16
16b
16a

FORMWORK FOR ROUND OR POLYGONAL CONSTRUCTION

CROSS-REFERENCE TO RELATED CASE

The formwork of the present invention is somewhat similar to that which is disclosed in the commonly owned copending patent application Ser. No. 649,473 filed Sept. 11, 1984 for "Apparatus for erecting arcuate walls of concrete or the like", now U.S. Pat. No. 4,619,433 granted Oct. 28, 1986. The disclosure of the application Ser. No. 649,473 is incorporated herein by reference.

BACKGROUND OF THE INVENTION

The present invention relates to formworks for round or polygonal constructions, especially to formworks which are free of tensioning points and comprise a formwork face or sheathing having an adjustable curvature or circumference and comprising a chain of booms which are spaced apart from the formwork face and have individual boom portions, the boom portions being adapted to pivot relative to one another so as to alter their mutual angular positions by means of joints and being fixable in selected angular positions when the adjustment of the formwork face is completed.

A similar formwork is disclosed in German printed patent application No. 21 40 638. The individual boom portions are coupled to each other by joints about which they can be adjusted relative to one another. A threaded bolt extending in spaced relationship to the joint serves for adjustment and fixing. In order to adjust the formwork to a selected circumference or curvature, the boom portions must first be adjusted and fixed in their relative angularity and only thereafter can the formwork face or sheathing be applied. Therefore, the assembly of such formworks is time-consuming. The play in the individual joints, and particularly the combined play in all of the joints, may lead to considerable deviation from the desired angular position.

German Auslegeschrift No. 28 05 612 discloses a formwork wherein the faces of the individual boom portions again feature connecting joints flanked by screw bolts with threads for adjusting the angular positions of the boom portions. Thus, if installed carefully, the play in the joints can be eliminated. However, the installation is time-consuming and the relative positions of individual boom portions must be adjusted before the formwork face or sheathing can be applied.

OBJECTS AND SUMMARY OF THE INVENTION

An object of the invention is to provide a formwork wherein the curvature or relative positions of the boom portions can be selected in fully assembled condition of the formwork, i.e., with the formwork face applied and with the form panels fastened to the booms, the forces encountered being absorbed in the chain of booms without play. This object is accomplished in that the joint axes which allow for the adjusting and swivelling motion of the boom portions are disposed in the plane of the formwork face or sheathing and the boom portions are disposed in spaced relationship thereto and have couplings which are located on arcs having centers of curvature on the respective joint axes and are adapted to be detachably connected to one another. Since the axes for the adjusting and swivelling motion lie in the plane of the formwork face, the latter need only be movable in the regions of such axes, e.g., as known from formwork corners or from German published patent application No. 24 03 325. Therefore, the possibly interrupted formwork face and the entire formwork can participate in the adjusting and swivelling motion as the curvature or circumference is being adjusted. The boom portions are also swivelled relative to one another; however, due to their distance from the pivot axes, they are additionally moved relative to one another with their faces, this being rendered possible by the detachable couplings which are adapted to be reconnected in the respective setting. Joints with play on the boom portions themselves are thus eliminated.

In accordance with a presently preferred embodiment of the invention, a substantially U-shaped formwork element is disposed between two adjacent form panels, i.e., those defining the formwork face, and the U-legs of such element serve to join the marginal webs of two form panels. The transverse web of the element forms part of the formwork face and is pliant or is provided with a hinge to define the joint axis. This ensures the formation of a substantially closed formwork face or sheathing with stable form panels or boards which are adapted to be swivelled relative to one another through the interposed pliant or hinged formwork element. In this simple manner, the swivel axis can be placed into the plane of the formwork face. Good adjustability is afforded, above all, by a U-shaped formwork element with a pliant formwork face which has a closed surface as compared to a hinged embodiment.

For coupling the boom portions to one another, they may have plates or like parts which overlap one another and have coupling bores or openings which are disposed along an arc about the joint axis and wholly or partly overlap or come to overlap one another as the curvature is being adjusted. For fixing the plates in the respective adjusted positions, insert members may be provided which pass through the registering coupling bores to lock the boom portions in the selected positions. This provides a form-locking, stable coupling which is devoid of play and is capable of transmitting large forces while securely fixing the boom portions in selected angular positions.

If the bores of the connectable plates are at different distances, even slight adjustment leads again to their overlapping, thus enabling very small swivel motions to be made and fixed.

According to a preferred embodiment of the invention, infinitely variable adjustment and nevertheless form-locking coupling can be attained at the boom portions in that the coupling bores are oblong openings and in that the oblong bores of the plates of the one boom portion are staggered along the arc with respect to those of the other plate in such a manner that the distances of the oblong bores of the one plate are different from those of the other plate, and that keys having the same cross section as the oblong bores are provided as the insert members. The keys can be driven in to different depths, depending on the adjustment of the boom portions and the oblong bores with respect to one another, thus providing for infinitely variable adjustment and nevertheless form-locking fixation. To keep transverse forces away from the joint in the plane of the formwork face, the radial width of the keys may correspond to that of the oblong bores.

The coupling for the boom portions is simple to produce, easy to operate and nevertheless effective if in each case two curved oblong bores of cooperating plates partly overlap one another and two keys are provided which engage the plate of the one boom portion at the oblong bore edges facing away from one another and engage the plate of the other boom portion at the oblong bore edges facing one another, when they are keyed. Thus, the plates are braced with respect to one another at the oblong bores, the overlapping of the oblong bores and thereby the driven-in depth of the two keys provided for coupling varying according to adjustment of the plates relative to one another. Such coupling is stable for any setting and hence for any of an infinite number of adjustments.

The keys are stably and securely held in the respective coupling positions if the boom portion has on the one face two plates lying parallel one above the other and has on the other face a coupling plate fitting between the two plates. The plates belonging to one another in pairs on the one face then naturally have conforming coupling bores, while on the other face or adjacent boom portion the other plate insertable therebetween has the staggered oblong bores.

To carry out the adjusting and swivelling motion of two boom portions, provision may be made for projections or the like in the end zones of the boom portions, in particular on the side thereof facing away from the formwork, such projections being engaged by a clamping bolt bridging the coupling zone of two interconnectable boom portions. Thus, the forces which are required to adjust the boom portions and the form panels held thereby can readily be applied while also permitting a fine adjusting motion. The bending undergone by the U-shaped connecting formwork element may be promoted by the formwork face thereof having a bending point and preferably being made of steel plate or plastic. For reasons of stability, however, the connecting formwork element may also be made from steel plate of suitable ductility. The clamping bolts are readily accessible at the side facing away from the formwork. They serve primarily to perform the adjusting and swivelling motion but they may also stiffen the chain of booms and thus perform a dual function.

The configuration of oblong bores in the direction in which the keys are driven in and their adaptation to the slant of the keys can be selected with a view to improve the keyed and holding condition in use.

The U-shaped connecting formwork elements may be wider for the outer formwork than for the inner formwork of a round construction and may at the same time serve as a means to compensate for the greater circumference of the outer formwork as compared to the inner formwork. This makes it possible to use identical form panels for the outer formwork and for the inner formwork and obviates the need for further elements or allows for a reduction of the number of additional elements having to be inserted between them to compensate for the difference in circumference.

In order to be able to use the formwork, and in particular the chain of booms thereof, for circular tanks or round constructions of different diameters, one embodiment of the formwork according to the invention may employ a chain of booms including at least one boom portion which, between its couplings for connection to adjacent boom portions, is adjustable in the longitudinal direction to alter its length.

The improved formwork for polygonal or round constructions can do away with tensioning points because the individual walls are shored by stable chains of booms allowing for simple and rapid adaptation to various curvatures without the chain of booms having to be pre-adjusted before the form panels are fastened to it. The installation of the formwork is thereby simplified and speeded up. Large forces can nevertheless be transferred by the chain of booms without any danger of changes in position due to play in joints or adjusting screws.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Formwork 1 serves for round or polygonal structures to be constructed free of tensioning points. The illustrated embodiment is designed for the construction of a polygon because the faces 3 of the form panels or sheaths 2 are of plane configuration. However, it would also be possible to use curved form panels or pliable ones for the erection of a round structure.

The composite face of the entire formwork 1 is adjustable with regard to its curvature or its circumference, as will be explained in further detail with reference to FIGS. 2, 3, 4, 5 and 7. The adjustment is also possible if the structure is not a complete ring but merely a wall which is correspondingly curved or polygonal.

Figure 2:
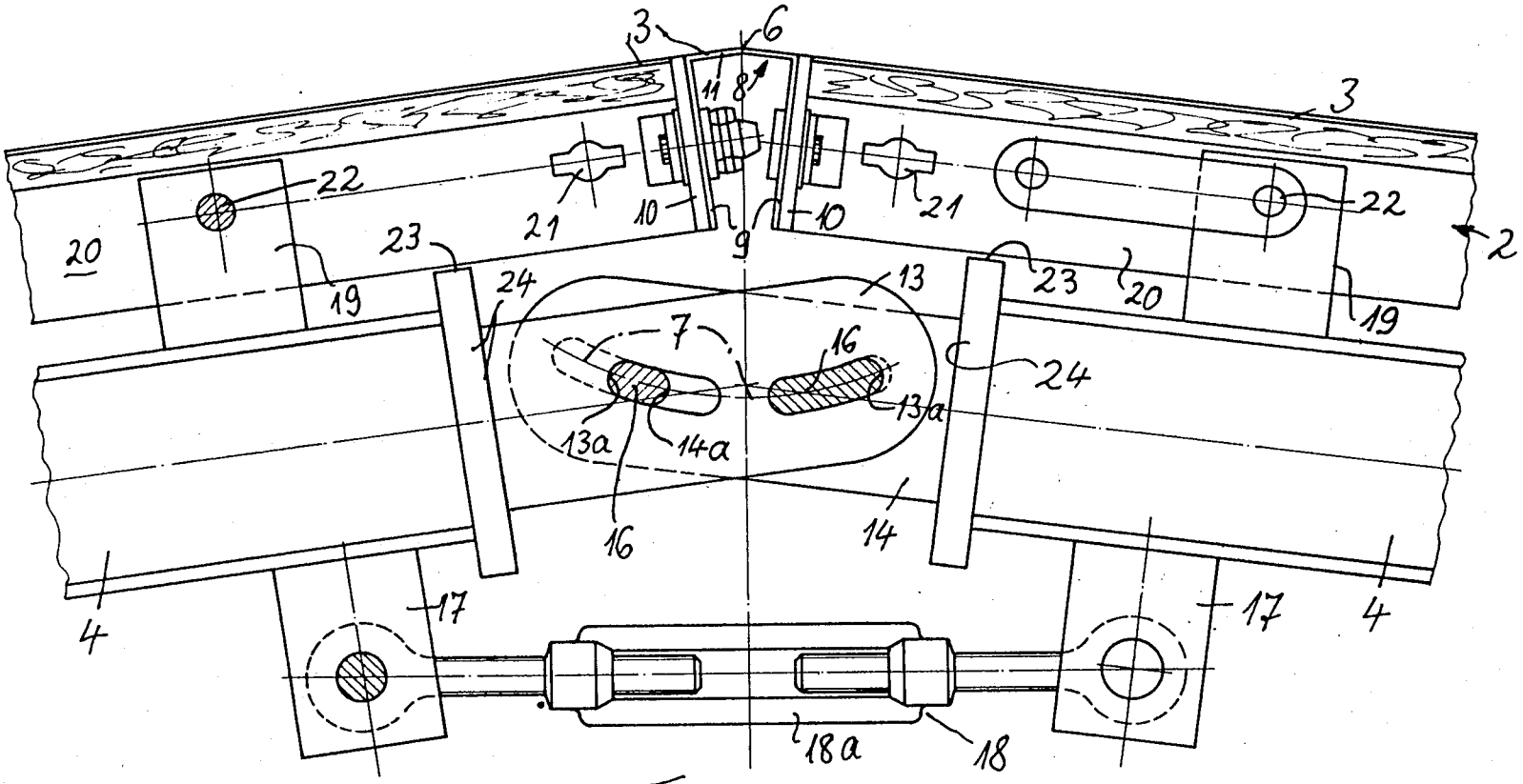
FIGS. 2 and 3 show, in two different positions, the connection between two adjacent form panels of the inner formwork.
Figure 3:
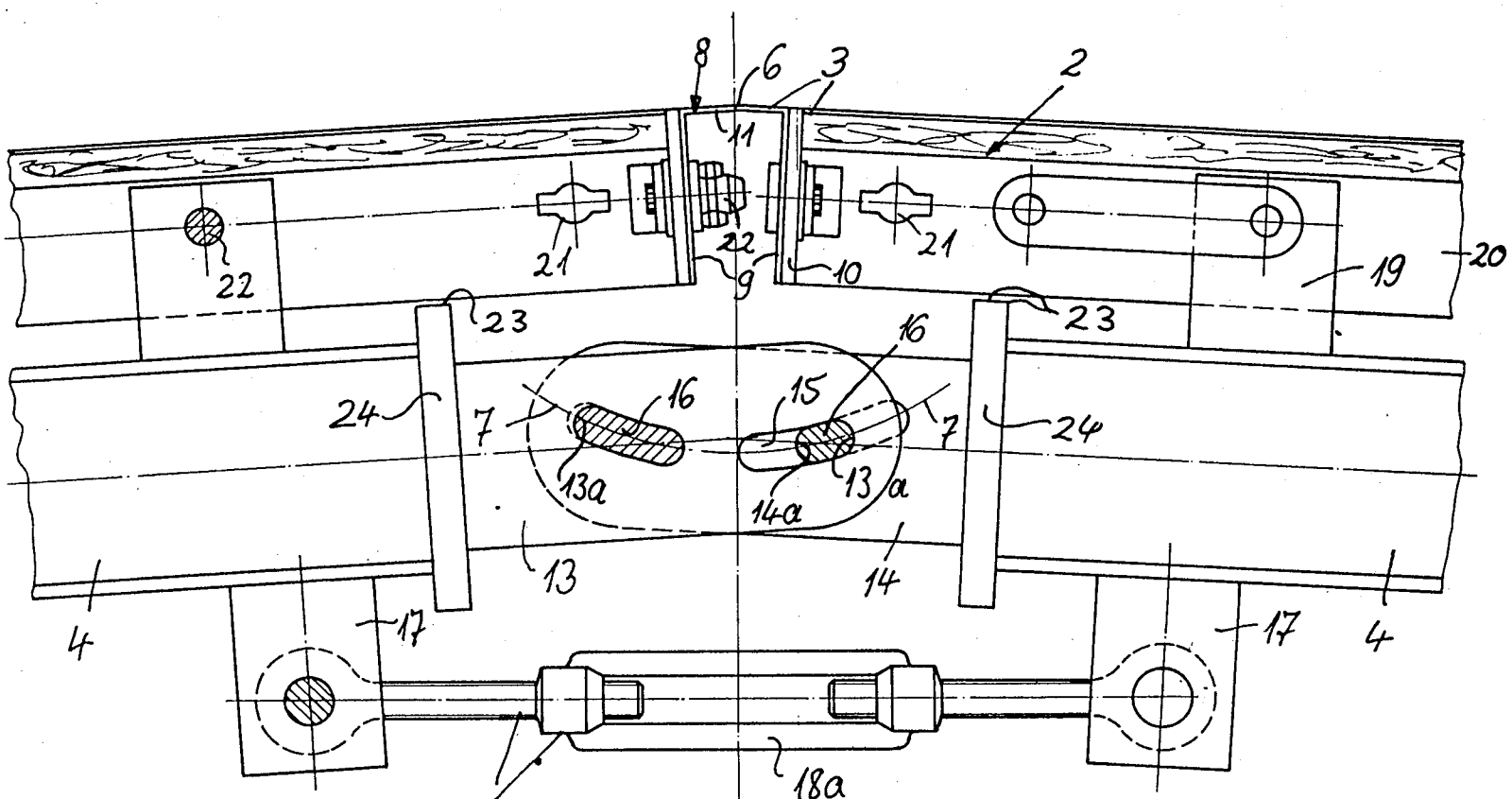

A series or chain 5 of booms having individual boom portions 4 engages the form panels 2 in a spaced relationship to the faces 3 to impart sufficient stiffness to the entire formwork while being able to dispense with tensioning points. The boom portions 4 are adapted to be pivoted relative to one another to change their mutual angular positions and to be fixed when the adjustment of the inclination of the faces 3 is completed. The manner in which the adjacent form panels or sheaths 2 and the associated boom portions 4 of the inner formwork section may assume different angular positions relative to one another is shown in FIGS. 2 and 3, and by reference to outer formwork section in FIGS. 4 and 5. In each case, one boom portion 4 corresponds to one form panel 2 and belongs thereto.

The joint or pivot axis 6 for the adjusting and swivelling motion of the boom portions 4 is disposed in the plane of the composite formwork face between two adjacent form panels 2, and the boom portions 4 extending in spaced relationship to the form panels 2 have couplings to be described in detail below. The couplings are disposed along arcs 7 whose centers of curvature are on the corresponding axes 6 and the couplings are adapted to be detachably connected to one another. The attachment of the boom portions 4 to the form panels 2 in this manner enables the coupling zones of the boom portions 4 to be disposed in those regions where the adjacent form panels have the joint or pivot axis 6 between them.

Figure 5:
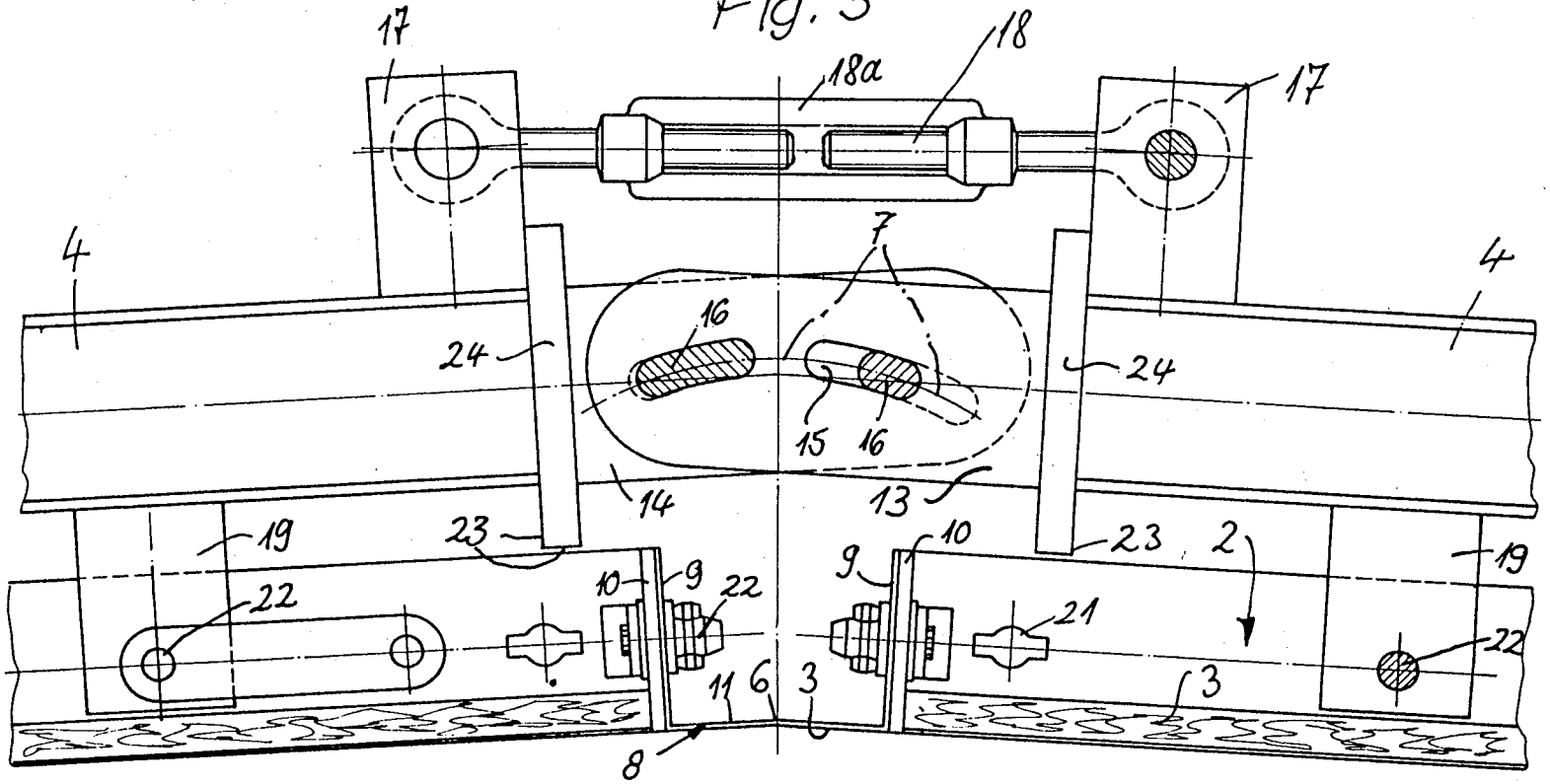
Figure 6:
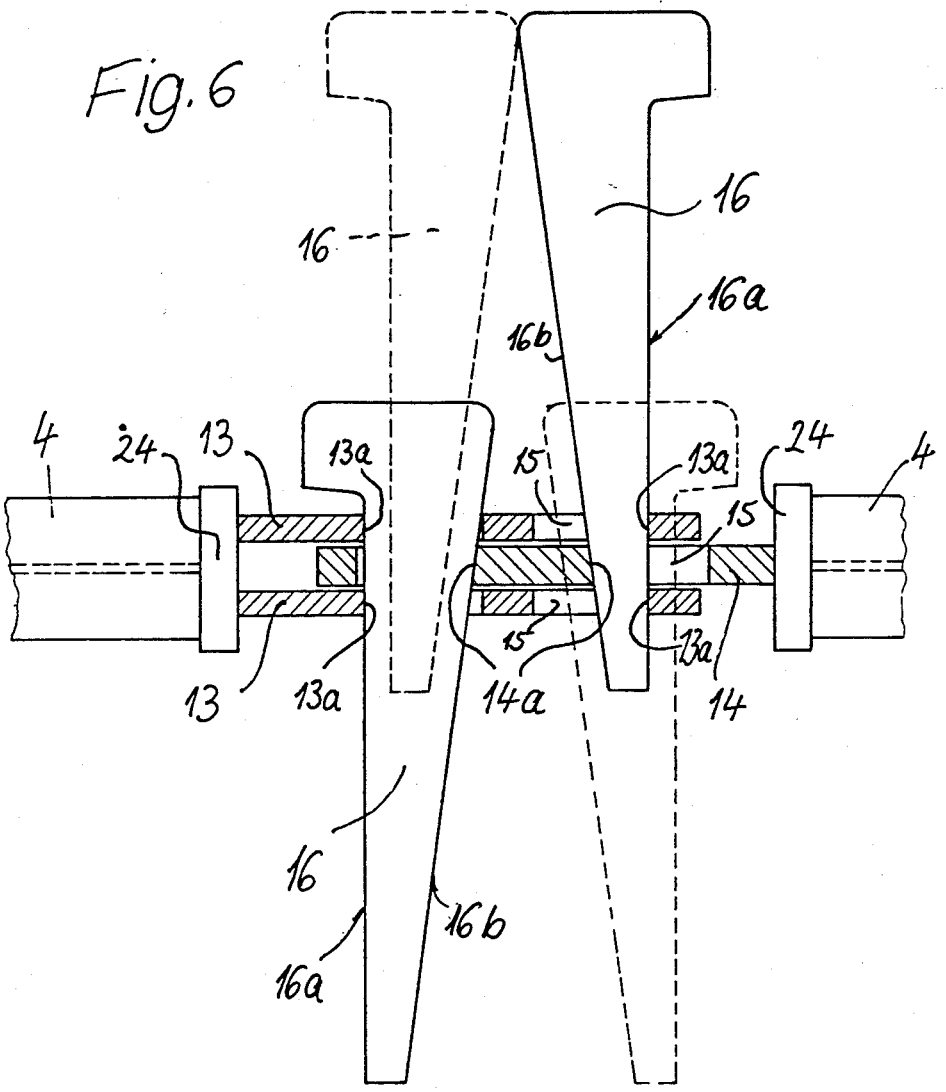
FIG. 6 is a side elevational view of the coupling between two interconnected boom portions, the coupling plates of the boom portions being shown in longitudinal section.
Figure 7:
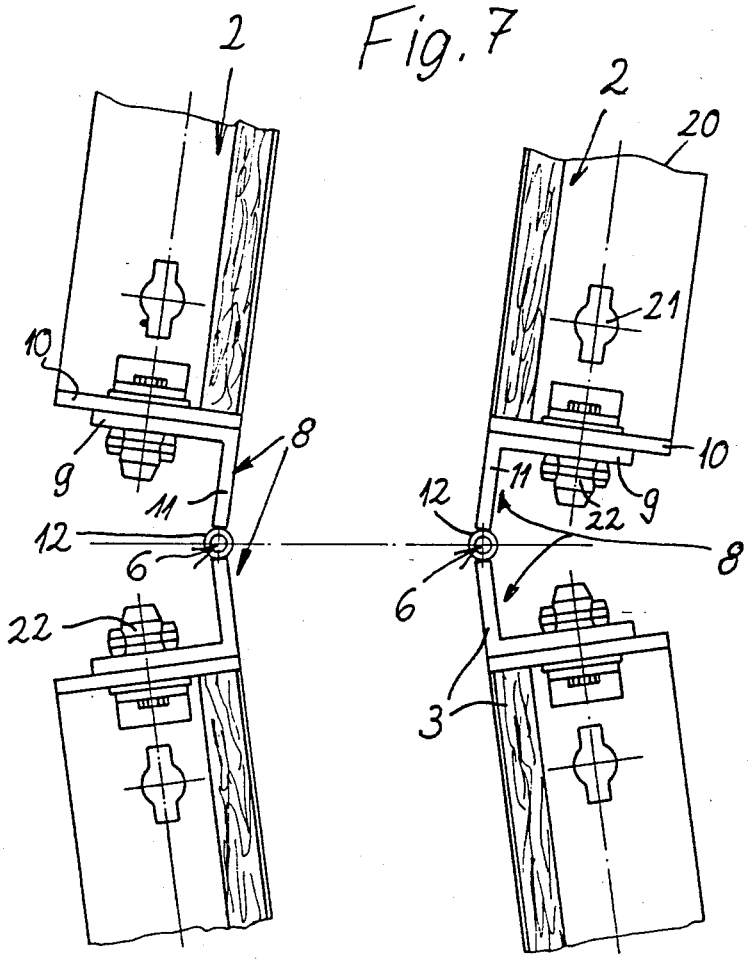
FIG. 7 shows a different embodiment of the connecting elements between two adjacent form panels.

In the embodiment of FIGS. 1–7, there is disposed between two adjacent form panels 2 an approximately U-shaped formwork element 8 whose U-legs 9 are connected to the marginal webs 10 of the two adjacent form panels 2. According to FIGS. 1 to 6, the transverse web 11 of the U-shaped element 8 is a formwork face which is pliant or is provided with a hinge 12, as shown in FIG. 7, and at the same time actually defines the joint axis 6. The connecting formwork element 8 is preferably made of steel plate.

As shown in FIGS. 1 to 5, the face of each U-shaped connecting formwork element 8 may have a bending point at the joint axis 6. This is particularly advantageous if the connecting element 8 is made of steel plate or plastic.

For coupling the boom portions 4 to one another, their detachable couplings may include extensions in the form of plates 13 and 14 which overlap one another and have coupling bores or openings 15 which are disposed on the arc 7 at a distance from the joint axis 6 and wholly or partly overlap or come to overlap one another as the curvature is being adjusted. Each coupling further includes insert members or affixing members which can take the form of keys 16 serving to fix the plates 13 and 14 in the selected adjusted positions and passing through the overlapping coupling bores 15 to lock the corresponding boom portions in selected positions. Thus, the joint axis 6 itself is no longer subject to pull or pressure as is the case with conventional boom systems where the boom portions are connected by joints on the faces. The novel couplings are form-locking in any adjusted position and can transfer correspondingly high forces.

According to FIG. 6, the bores 15 of the plates 13 and 14 have different clearances from one another. This ensures that the opposing bore edges can be braced with respect to one another by the keys 16.

Figure 4:
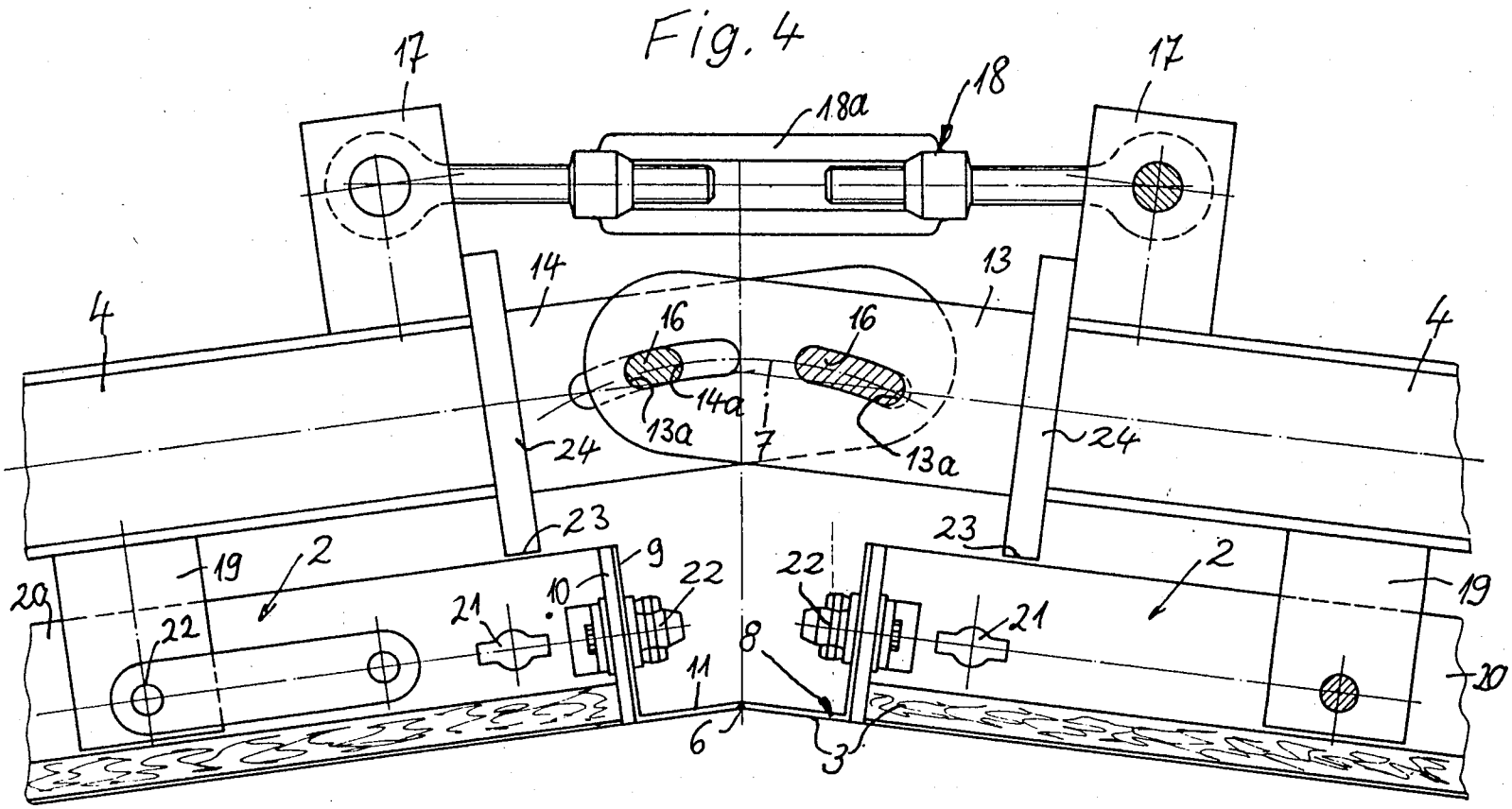
FIGS. 4 and 5 show on an enlarged scale the connection between two adjacent formwork panels of the outer formwork.

With reference to FIGS. 2 and 3 as well as FIGS. 4 and 5 in conjunction with FIG. 6, the coupling openings or bores 15 are oblong arcuate bores with a radius of curvature corresponding to the distance from the respective joint axis 6 at the formwork face so that the centers of the oblong arcuate bores are located on the arcs 7. Further, the oblong bores 15 in the plates 13 of the one beam portion 4 are staggered along the arcs 7 with respect to those of the other one in such a manner that the distances of the oblong bores of the one plate 13 are different from those of the other plate 14, while—as already mentioned—keys 16 having the same curvature in cross section as the oblong bores are provided as insert members. The radial width of the keys 16 corresponds to that of the oblong bores 15. By referring to FIG. 6 in conjunction with FIGS. 4 and 5 on the one hand or FIGS. 2 and 3 on the other hand, the effect of different clearances of the oblong bores 15 from one another becomes clear. Thus, the extent to which the oblong bores 15 overlap depends on the swivel angle of the boom portions 4 and their plates 13 and 14, so that the insertion of the two keys 16 varies in depth. When both keys are driven firmly into the overlapping regions of the oblong bores 15 into which they can penetrate, this position is fixed in a secure, immovable manner free of play. Accordingly, in each case two curved oblong bores of cooperating plates 13 and 14 overlap and interact with two keys 16 engaging the plate 13 of the one boom portion 4 at the oblong bore edges **13*a* facing away from one another and engaging the plate 14 of the other boom portion 4 at the oblong bore edges 14*a* facing one another, when they are keyed. Thereby both pull and pressure on the boom portions 4 is dependably transferred by way of their plates 13 and 14 and the two interposed keys 16, without any shift or displacement being possible. At the same time, installation and handling is simple because the user of formwork is accustomed to performing fixing work with the aid of keys, and stripping is simple because the key 16** is released by simply striking the narrow key end from below.

FIG. 6 shows that, in order to hold the keys 16 securely in their operative positions, each boom portion 4 has on the one face two plates 13 lying parallel one above the other and has on the other face a coupling plate 14 fitting between two such plates 13. The bores 15 of the two parallel plates 13 conform to one another and, therefore, above all the vertically extending key face **16*a* finds an abutment in both oblong bores 15 at the edges 13*a***.

In the embodiment of FIGS. 1 to 6, the length of the arcuate openings or bores 15 in all the plates 13 and 14 is approximately the same in order to make maximum use of the depth to which a key 16 is inserted, but the coupling bores 15 located on the single plate 14 have a larger clearance than that between the coupling bores 15 in the plates 13. As shown in FIG. 6, the slanting key face **16*b* thereby abuts against the edges 14*a* facing each other when the two keys 16** are braced.

FIG. 6 shows that, in their operative positions, the coupling plates 13 lying parallel one above the other have the bore edges **13*a* and the key faces 16*a* cooperating therewith approximately vertical, whereas the bore edges 14*a* of the single coupling plate 14 between the plates 13 slant downwardly in accordance with the inclination of the key faces 16*b*. Therefore, at their abutment faces, the keys 16 are in each case contacted over the entire width of thickness of the coupling plates 13 and 14**. Accordingly, the entire coupling is secure and free from play.

In order to carry out the adjusting and swivelling movements of two cooperating boom portions 4, projections 17 are provided in their end zones, on the side thereof facing away from the formwork 1, the projections being engaged by a clamping bolt or turnbuckle 18 bridging the coupling zone of two interconnectable boom portions 4. When the keys 16 are loosened or removed, the angular positions of two neighboring form panels 2 can be altered in a simple manner by turning the clamping sleeve **18*a* of the clamping bolt because the clamping bolt 18 is pivoted to the projections 17. After the adjustment is completed, the keys 16 are fixed in a manner described above, thereby fixing the boom portions 4 and form panels 2 in selected positions. In the fixed position, the clamping bolt 18 can additionally transfer forces and, therefore, has a dual function. However, there is no need for any special locking of the clamping bolt 18 in the holding position because the actual positional fixation takes place by means of the keys 16. Hence, the adjusting motion at the clamping bolt 18 is simplified as compared to adjusting bolts which also have to transfer the entire force and hold the adjustable parts in the adjusted positions and for this required lock or check nuts or the like. The clamping bolt 18 has two parts with threads in opposite directions for the clamping sleeve 18***a*. At the end zones of the boom portions 4, on the side in each case facing the form panels 2, there are plate-like projections 19 for connection to stiffening webs 20 of the form panels 2. The webs 20 have keyhole-like bores 21, and the plate-like projections 19 may have matching bores so that a corresponding bolt 22, possibly with a transverse pin or the like, can be used for fixation.

The portions 4 of the series or chain 5 of booms are thus fastened directly to the form panels 2 so that leverage is low. However, it is also possible to allow the chain 5 of booms according to the invention to engage girders which, in turn, support and stiffen the form panels 2 or a composite formwork face of any design. FIGS. 1 to 5 show that the U-shaped connecting formwork elements 8 for the outer formwork are wider than for the inner formwork so that they simultaneously serve as a means for compensating for the greater circumference of the outer formwork as compared to the inner formwork. Therefore, the number of dimensions of the form panels 2 for inner and outer formwork may be the same.

Figure 1:
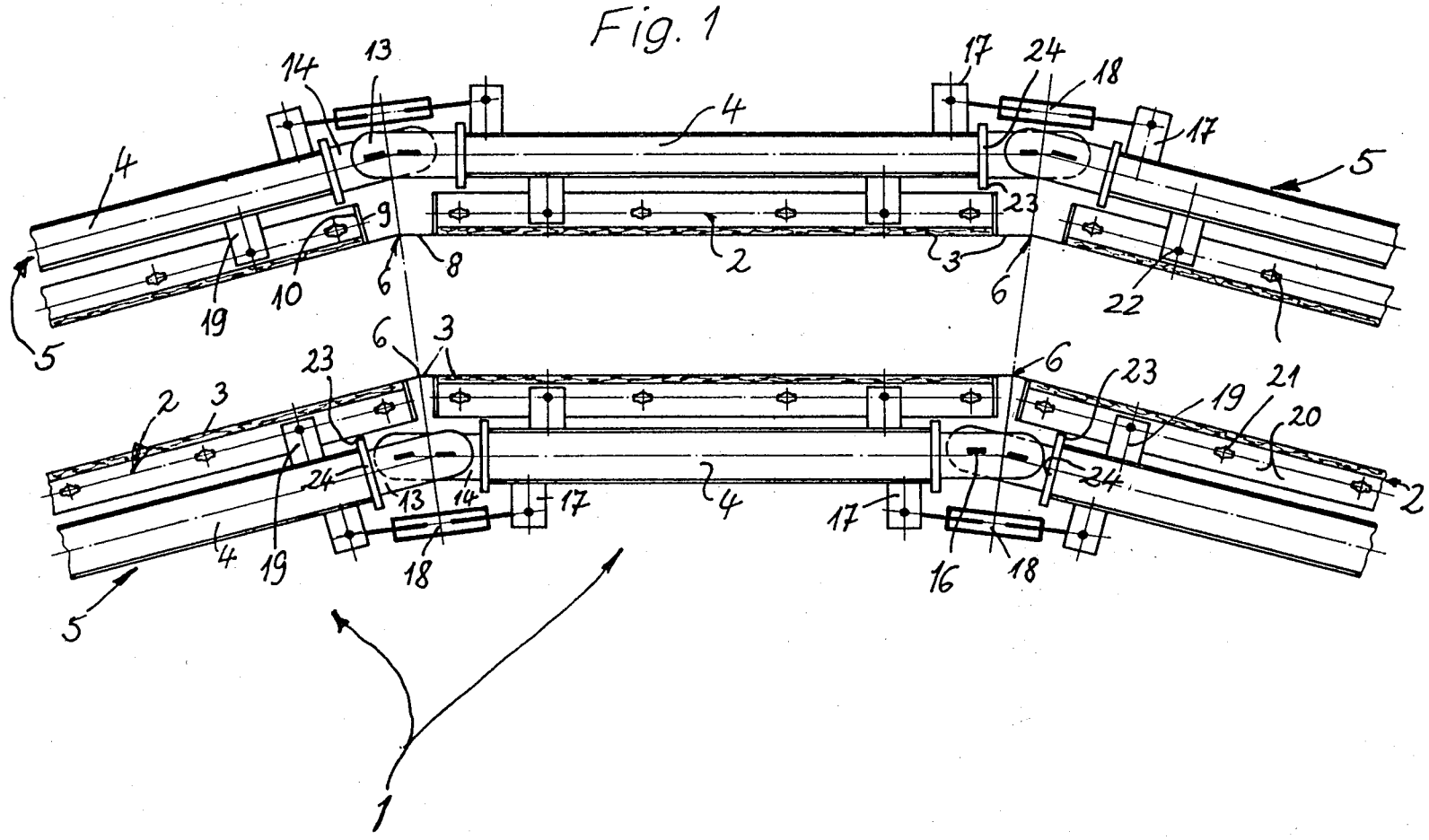
FIG. 1 is a plan view of a formwork for a polygonal structure with the composite formwork face or sheathing taking a curved course, the inner and outer formworks facing one another and being free of tensioning points.

In the embodiment of FIG. 1, the form panels 2 of the inner and outer formworks are exactly opposite one another, so that the coupling locations in each case lie on a common radius of the respective construction. However, it is equally possible to stagger the two formwork systems in the circumferential direction with regard to the boom portions 4, the form panels 2 and their connecting means.

To increase the stability of the formwork 1, preferably free of tensioning points, it is expedient if—in addition to the connecting projections 19—the boom portion 4 has at least one support 23 which faces the form panel 2 and which can contact the form panel 2 at its side facing away from the concrete and shored. Such additional supports 23 with respect to the form panel 2 may be provided at least at the two ends, but additionally also or alternatively in the center zone of a boom portion 4.

One head plate 24 can be provided at each of the front ends of each boom portion 4 to extend transversely or at right angles to the longitudinal direction of the boom portion 4 and on one side of which the coupling plate 3 is disposed and on the other side of which the two coupling plates 14 are disposed. The head plates 24 project laterally beyond the respective boom portion 4 toward the form panel 2 and hence their projecting portions can act as the supports 23. For the sake of clarity, FIGS. 2 to 5 show small clearances between the supports 23 of the head plates 24 and the respective webs 20 of the form panel but of course such clearances are not present in the case of support. In this manner, the couplings for the boom portions 4 perform an additional function by also acting as additional supports 23, all the forces encountered in this zone being transferred into boom portion 4 in a beneficial manner very close together and with low leverage.

The formwork can be caused to conform stepwise to different dimensions of round constructions by altering the number of boom portions 4.

Figure 8:
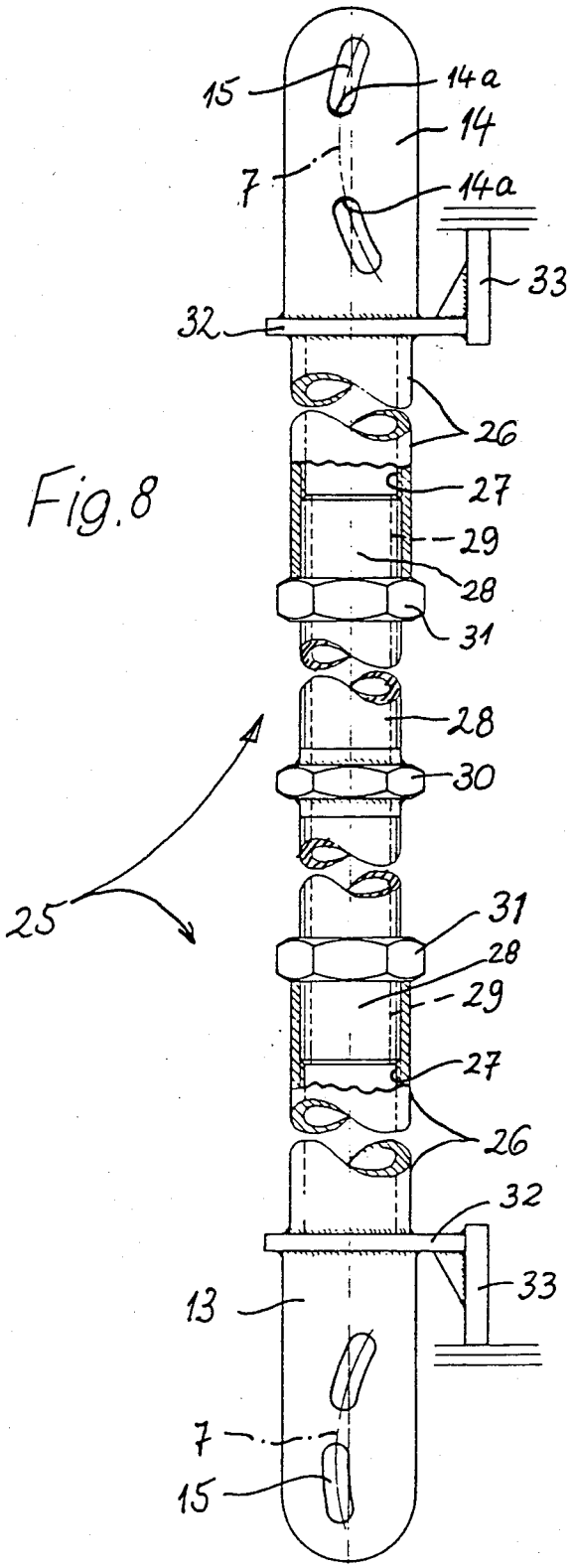
FIG. 8 shows a variable-length boom portion.

FIG. 8 shows a special boom portion 25 which fits the chain of booms and, between its couplings, i.e., plates 13 and 14 serving for connection to adjacent boom portions 4, is adjustable in the longitudinal direction to alter its length. If the chain of booms includes at least one such boom portion 25 which is adjustable in the longitudinal direction to alter its length, then virtually infinitely variable adjustment to different dimensions is possible because the measurements between individual steps can be compensated for by the longitudinal adjustability of the boom portion 25 or possibly a plurality thereof added to the boom system. Such compensating boom portions 25 may be provided both on the outside and inside of the formwork 1.

The boom portion 25 is adjustable in the longitudinal direction and serves to connect two end boom portions 4 of its chain 5 of booms and to compensate for any dimensional discrepancies. Its coupling elements 13 and 14 match those of the other boom portions 4. In the embodiment of FIG. 8, the elements 13 and 14 are plates with oblong arcuate bores into which the keys 16 fit, like the previously described boom portions 4.

Longitudinal adjustability of the compensating boom portion 25 can be realized by means of two parts 26 with threads 27 in opposite directions and a connecting piece 28 with counter threads 29 mating with the oppositely directed threads 27. In the illustrated embodiment, the adjustable boom portion 25 has on its coupling plates 13 and 14 in each case parts 26 in the form of sockets with internal threads 27 for engagement by a connecting piece 28 in the form of a rod having at either end an external thread 29 in each case fitting the internal threads 27 of the sockets 26. In FIG. 8, the connecting rod 28 has a portion 30 of polygonal shape, in the exemplified embodiment a hexagon, for engagement by a spanner or a similar tool in the region between its external threads 29 so that the desired adjustment and rotation of the connecting rod for drawing the sockets 26 together or urging them apart can be easily performed.

On the faces of the sockets 26 of the adjustable boom portion 25 there are check nuts or lock nuts 31 on the external threads 29 of the connecting rod 28, the internal threads of the check nuts corresponding to the internal threads 27 of the respective adjacent sockets 26.

In this manner, the adjusted length of the boom portion 25 can be fixed by applying the respective check nut 31 firmly against the face of the respective socket 26 after the correct length has been selected.

For support relative to the form panels 2, there is provided between the coupling plates 13 and 14 and the threaded portion, i.e., in the exemplified embodiment sockets 26, in each case a holding plate 32 bearing these two parts on both sides. Each holding plate 32 is extended in the direction toward the form panels 2 and carries a stop member 33 which serves to abut the outer sides of the form panels 2 or the webs 20 thereof and is preferably welded to the respective plate 32.

If the desired dimension of a round formwork cannot be exactly selected by the boom portions 4, one of them can be replaced by a compensating boom portion 25 or the latter is inserted between two boom portions 4 and its length is adjusted to account for the remaining dimensional discrepancy. This is possible by simply rotating the connecting rod 28. Thus, the formwork according to the invention permits virtually infinitely variable adjustment to any dimensions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A formwork for round or polygonal constructions, comprising a formwork face which is adjustable as to at least one of the parametrs including its curvature and its circumference; a series of booms including individual boom portions spaced apart from said formwork face and arranged to pivot relative to each other, at least one of said boom portions being of variable length; joints provided between neighboring boom portions and having axes disposed at least close to said formwork face; and means for releasably coupling the neighboring boom portions to each other, said coupling means comprising extensions provided on neighboring boom portions and movable relative to each other along arcs having centers of curvature at least close to the axes of the respective joints, and means for affixing the extensions to each other in selected positions of the respective boom portions.

2. The formwork of claim 1, wherein said formwork face includes a plurality of neighboring panels and said joints comprise substantially U-shaped formwork elements between neighboring panels, said elements having legs affixed to the neighboring panels and deformable webs disposed between the respective legs and defining the corresponding pivot axes.

3. The formwork of claim 2, wherein said webs ar pliant.

4. The formwork of claim 2, wherein said webs include hinges.

5. The formwork of claim 2, wherein said webs include steel plates.

6. The formwork of claim 2, wherein said webs are pliant and include a plastic material.

7. The formwork of claim 1, wherein said formwork face includes a discrete panel for each of said boom portions and said joints are disposed between neighboring panels.

8. The formwork of claim 1, wherein said extensions have openings at least partially overlapping each other and said affixrng means include keys in said openings.

9. The formwork of claim 8, wherein at least some of said openings are oblong.

10. The formwork of claim 9, wherein said openings have centers on the respective arcs, the opening of one extension on each of said arcs being staggered with reference to the opening of the other extension on the respective arc.

11. The formwork of claim 1, wherein each boom portion has two extensions one of which includes a single plate and the other of which includes two spaced-apart plates, the single plate of one of two neighboring boom portions being disposed between the spaced-apart plates of the other of such two neighboring boom portions.

12. The formwork of claim 1, further comprising means for pivoting neighboring boom portions of said series relative to each other, said pivoting means comprising projections provided on said boom portions and extending away from said formwork face, and means for moving the projections of neighboring boom portions relative to each other.

13. The formwork of claim 12, wherein said moving means comprises turnbuckles.

14. The formwork of claim 1, wherein said boom portions have end portions provided with substantially plate-like projections and said formwork face includes panels having stiffening means each connected with the projection of a discrete boom portion.

15. The formwork of claim 1, including an outer formwork section and an inner formwork section, each of said sections having a formwork face including a plurality of panels, a series of booms having boom portions, one for each panel of the respective formwork face, a joint between each pair of neighboring panels, and means for coupling each pair of neighboring boom portions to each other, each of said joints including a connecting formwork element having legs affixed to neighboring panels and a web in the region of the respective formwork face, the width of webs forming part of formwork elements in said outer section exceeding the width of webs forming part of formwork elements in said inner formwork section.

16. The formwork of claim 1, wherein each of said boom portion has first and second end portions provided with projections connected to said formwork face and at least one end portion of each of said boom portions further includes a support extending toward the formwork face.

17. The formwork of claim 16, wherein each of said boom portions includes at least three supports, one at each of the end portions and at least one intermediate the end portions.

18. The formwork of claim 1, wherein each of said boom portions has a first and a second end portion and at least one of said end portions includes a head plate carrying one of the respective extensions.

19. The formwork of claim 18, wherein each of said head plates includes a support for said formwork face.

20. The formwork of claim 1, wherein said series of booms forms an annulus so that said one boom portion can change the circumference of said annulus.

21. The formwork of claim 20, wherein said at least one variable length boom portion has two end portions and its extensions include plates provided at said end portions thereof.

22. The formwork of claim 1, wherein said one boom portion includes first and second parts having threads inclined in opposite directions and a third part having first and second threads mating with the threads of said first and second parts, respectively.

23. The formwork of claim 22, wherein said first and second parts have internal threads and said third part has external threads.

24. The formwork of claim 23, wherein said third part is disposed between said first and second parts and includes a polygonal portion engageable by a tool to rotate said third part relative to said first and second parts.

25. The formwork of claim 23, further comprising first and second lock nuts mating with the first and second threads of said third part and movable into locking engagement with said first and second parts, respectively.

26. The formwork of claim 22, wherein each of said first and second parts includes a holding plate and a stop member provided on the holding plate and arranged to abut said formwork force.

27. A formwork for round or polygonal constructions, comprising a formwork face which is adjustable as to at least one of the parameters including its curvature and its circumference; a series of booms including individual boom portions spaced apart from said formwork face and arranged to pivot relative to each other; joints provided between neighboring boom portions and having axes disosed at least close to said formwork face; means for releasably coupling the neighboring boom portions to each other, said coupling means comprising extensions provided on neighboring boom portions and movable relative to each other along arcs having centers of curvature at least close to the axes of the respective joints, and means for affixing the extensions to each other in selected positions of the respective boom portions; and means for pivoting neighboring boom portions of said series relative to each other, comprising projections provided on said boom portions and extending away from said formwork face, and turnbuckles for moving the projections of neighboring boom portions relative to each other.

28. The formwork of claim 27, wherein at least one of said boom portions is of variable length.

29. A formwork for round or polygonal constructions, comprising an outer formwork section and an inner formwork section, each of said sections having a formwork face which is adjustable as to at least one of the parameters including its curvature and its circumference and each formwork face including a plurality of panels; a series of booms for each of said sections, each of said series including an individual boom portion spaced apart from the respective formwork face and the boom portions of each of said series being arranged to pivot relative to each other, there being one boom portion for each panel of the respective formwork face; a joint between each pair of neighboring panels in each of said formwork faces, each of said joints comprising a connecting formwork element having legs affixed to neighboring panels and a web in the region of the respective formwork face, the width of webs forming part of formwork elements in said outer section exceeding the width of webs forming part of formwork elements in said inner formwork section; and means for releasably coupling each pair of neighboring boom portions to each other, said coupling means comprising extensions provided on neighboring boom portions and movable relative to each other along arcs having centers of curvature at least close to the axes of the respective joints, and means for affixing the extensions to each other in selected positions of the respective boom portions.

* * * * *